US006731768B1

(12) United States Patent
Delage

(10) Patent No.: US 6,731,768 B1
(45) Date of Patent: May 4, 2004

(54) HEARING AID HAVING SWITCHED RELEASE AUTOMATIC GAIN CONTROL

(75) Inventor: David J. Delage, Portsmouth, NH (US)

(73) Assignee: Etymotic Research, Inc., Elk Grove, IL (US)

( * ) Notice: Subject to any disclaimer, the term of this patent is extended or adjusted under 35 U.S.C. 154(b) by 629 days.

(21) Appl. No.: 09/626,232

(22) Filed: Jul. 26, 2000

(51) Int. Cl.[7] ..... H04R 25/00

(52) U.S. Cl. ..... 381/312; 381/321; 381/102; 381/123

(58) Field of Search ..... 381/312, 320, 381/321, 57, 102, 104, 107, 123, 23.1

(56) References Cited

U.S. PATENT DOCUMENTS 3,571,529 A * 3/1971 Glenview et al. ..... 381/321

FOREIGN PATENT DOCUMENTS

WO WO 99/34642 * 7/1999

* cited by examiner

*Primary Examiner*—Huyen Le
(74) *Attorney, Agent, or Firm*—McAndrews, Held & Malloy, Ltd.

(57) ABSTRACT

An improved hearing aid is disclosed having a switched release automatic gain control. In one embodiment, an input signal is presented to a comparator with a reference typically around, for example, 65 dB SPL instantaneous. The output of the comparator controls a switch in a release circuit of an automatic gain control. While the instantaneous input level exceeds the threshold, the release circuit is enabled and the automatic gain control behaves normally. While the instantaneous input level does not exceed the threshold, the release circuit is disabled and the automatic gain control maintains its current gain setting, essentially indefinitely. Because speech, even soft speech, has a very high positive peak content, this circuit will recover any needed gain in the presence of speech (assuming an appropriate threshold) but not recover gain to background noise whose positive peak content is below the threshold. This dramatically reduces the "pumping" effect for which prior art automatic gain controls are well known.

20 Claims, 8 Drawing Sheets

HEARING AID HAVING SWITCHED RELEASE AUTOMATIC GAIN CONTROL

BACKGROUND OF THE INVENTION

Generally stated, hearing aids attempt to amplify the wide dynamic range of sounds found in the real world into the limited dynamic range of sounds that the impaired ear can hear. Crude hearing aids accomplish the need for different gain or volume levels by providing a manual volume control that may be manipulated by a user. More sophisticated hearing aids, however, use some form of automatic gain control or automatic volume control ("AGC").

FIG. 1A illustrates a typical prior art AGC circuit. The circuit 101 comprises a variable gain amplifier 103 for adjusting the gain, an attack time constant resistor $R_a$ 105, a diode 107, a release or recovery time constant resistor $R_r$ 109, and a storage capacitor $C_S$ 111. In operation, as $V_{out}$ increases, representing louder sounds, the diode 107 conducts, charging the storage capacitor $C_S$ 111. Charging of capacitor $C_S$ 111 in turn causes the variable gain amplifier 103 to reduce gain so $V_{out}$ returns towards a fixed level. As $V_{out}$ decreases, representing quieter sounds, the diode 107 no longer conducts, causing capacitor $C_S$ 111 to discharge through recovery resistor $R_r$ 109. This, in turn, causes the variable gain amplifier 103 to increase gain so again $V_{out}$ returns toward a fixed level. In other words, the ACG 101 increases gain for soft sounds or in the absence of sounds, and decreases gain for loud sounds.

While such a configuration was an improvement over manual volume/gain controls, it suffered from its own problems. For example, most hearing aids having an AGC circuit similar to that shown in FIG. 1A utilize fairly fast (e.g., approximately 10 mS) attack times and moderately fast (e.g., approximately 100–300 mS) release times. Shorter release times create noticeable distortion. If a longer release time is used, however, whole sentences may be missed following a sudden loud noise, such as, for example, a slamming door. Further, when the gain increases dramatically during quiet periods, the increased gain frequently causes feedback.

In addition, because of the very wide dynamic range of sounds in the real world and the very limited dynamic range of the impaired ear, high compression ratios are desirable. When combined with typical attack/release times mentioned above, however, high compression ratios cause a phenomenon known as "pumping." More specifically, the background noise is amplified to a near normal level during brief pauses in speech, resulting in the user hearing word/noise/word/noise, etc. Prior art designs attempted to reduce the pumping effect by adjusting the threshold knee higher (above which the AGC is active), but resulted in mediocre, at best, results. In any case, such a prior art AGC design necessitates compromises among all the possible settings of compression ratio, attack time, release time and threshold knee.

One prior art attempt to improve over typical AGC designs, such as that shown in FIG. 1A, is to use two separate AGC circuits in series. The first AGC circuit is given fairly slow (e.g., approximately 1 second) attack/release times, and the second is given fairly fast (e.g., approximately 10 mS) attack/release times for signals at some level above the current level of the first AGC circuit. While this circuit is an improvement over typical AGC designs, it still suffers from the "pumping" effect, just more slowly.

Another prior art attempt to improve over typical AGC designs is shown in FIG. 1B. As can be seen, the circuit 113 of FIG. 1B includes the same components of FIG. 1A, but adds a transistor $Q_1$ 115 in series with recovery resistor $R_r$ 109. The input of the circuit 113 is connected to the base of the transistor $Q_1$ 115 through a preamplifier 117. In this configuration, the transistor $Q_1$ 115 acts as a switch with the base-emitter voltage as the reference. The base of transistor $Q_1$ 115 is driven by preamplifier 117 whose gain is a function of a feedback resistor $R_r$ 119 and input resistor $R_i$ 121. The values of these resistors are chosen to establish an output level of the preamplifier 117 equal to the base-emitter voltage of transistor $Q_1$ 115 when the input equals the desired threshold, typically 65 dB peak instantaneous.

In operation, for signals whose instantaneous amplified level exceeds the base-emitter voltage of the transistor $Q_1$ 115 (e.g., signals above 65 dB SPL), the transistor is on and the release or recovery time constant resistor $R_r$ 109 is connected to ground. In this case, i.e., during the time the input is instantaneously above 65 dB SPL, for example, the circuit 113 of FIG. 1B acts like the conventional AGC circuit 101 of FIG. 1A. During the time that the amplified level is below the base-emitter voltage of the transistor $Q_1$ 115 (e.g., below 65 dB SPL), however, the release or recovery time constant resistor $R_r$ 109 is disconnected from ground, causing the gain to be maintained at the most recent setting.

While the circuit 113 of FIG. 1B may arguably be an improvement over the circuit 101 of FIG. 1A, it still suffers from many of its own problems. For example, because the base-emitter forward bias voltage of the transistor $Q_1$ 115 performs the decision function, the threshold is ill defined. More specifically, the threshold is not a clear on/off characteristic, but rather an on/mostly-on/partly-on/partly-off/mostly-off/off characteristic. In other words, the circuit has multiple release time constants. Because the transistor is not fully on, recovery to soft speech is much slower than desired. Also, because the transistor is not fully off, undesired recovery occurs over a period of seconds. In other words, the transistor has a "slushy" threshold and requires large amounts of preamplifier gain to reach that threshold.

In addition, the very fast attack time and "slushy" recovery to soft speech creates an undesirable effect if a loud noise (e.g., door close, book slam, etc.) occurs in an environment of soft conversation. More specifically, the loud noise and fast attack time cause immediate and complete gain reduction, while a soft voice enables gain expansion only occasionally, causing the user to miss much of what is spoken.

It is therefore an object of the present invention to provide an improved AGC circuit for hearing aid and other related applications.

Other objects of the invention will become apparent from the following detailed description of the invention when considered in conjunction with the accompanying drawings.

BRIEF SUMMARY OF THE INVENTION

An improved automatic gain control circuit for hearing aid and other related applications is provided. In one embodiment, the automatic gain control circuit or system is contained in a hearing aid. The hearing aid has an input transducer for converting sound energy into an electric signal. The hearing aid also includes control circuitry that receives the electrical signal and controls the gain of the electrical signal. In controlling the gain, the control circuitry uses only two release time constants, one representative of a gain control mode and the other representative of a gain adjust mode. A switch, which may be part of the control circuitry, is also included for switching between only the two time constants. The switch may, for example, select a short time constant if the amplitude of the electrical signal is greater than a predetermined threshold, and a relatively longer time constant if the amplitude of the electrical signal is less than the predetermined threshold. While this is the general case, selection of the longer release time constant may be delayed (i.e., the shorter release time constant may be retained) for a given period of time after the amplitude of the electrical signal falls below the predetermined threshold. Alternatively, the shorter release time constant may be selected for a period of time after the amplitude of the electrical signal rises above the predetermined threshold even if the amplitude of the electrical signal falls below the predetermined threshold during that period of time.

In any case, once the gain is set, an output transducer converts the gain controlled electrical signal into sound energy for transmission into the ear canal of a hearing aid user/wearer.

These and other advantages and novel features of the present invention, as well as details of an illustrated embodiment thereof, will be more fully understood from the following description and drawings.

DETAILED DESCRIPTION OF THE INVENTION

Figure 1A:
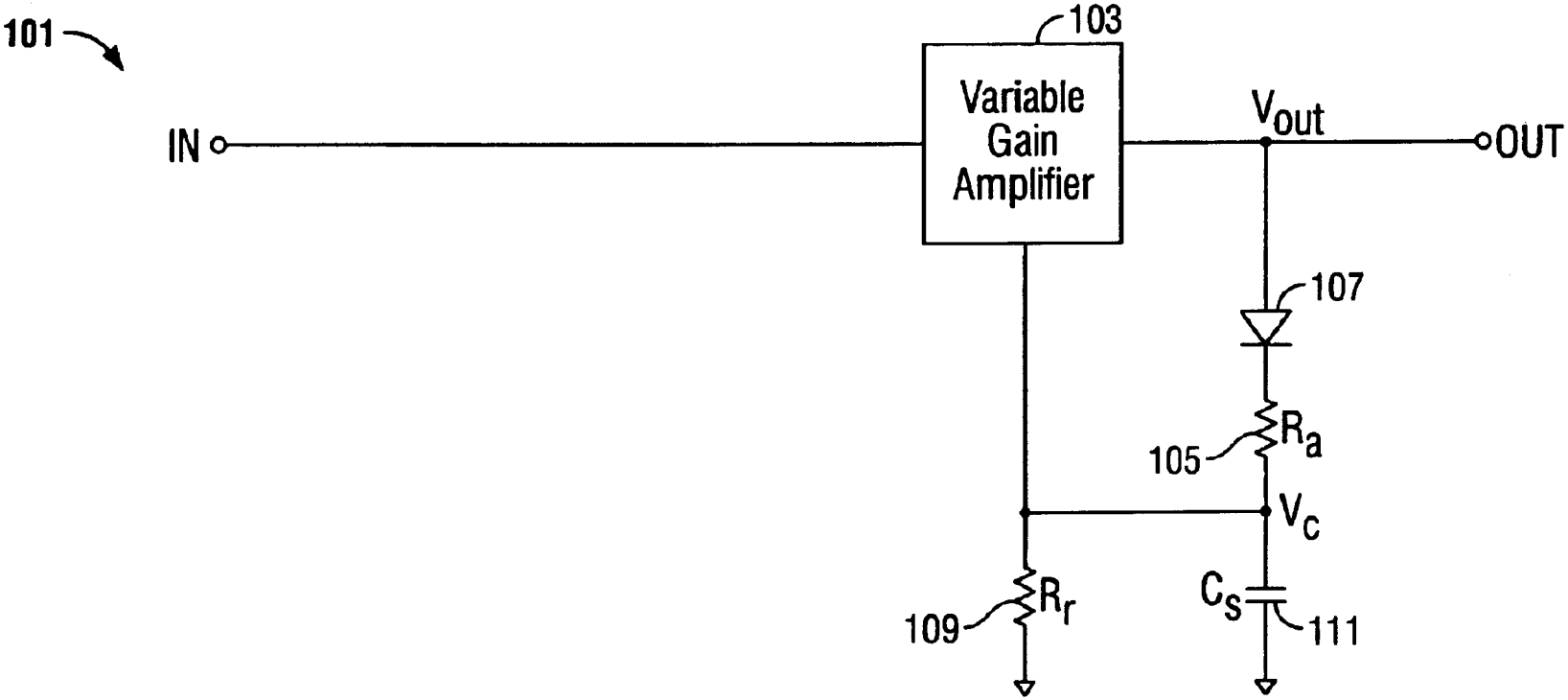
FIG. 1A (Prior Art)
FIG. 1A illustrates a typical prior art automatic gain control circuit.
Figure 1B:
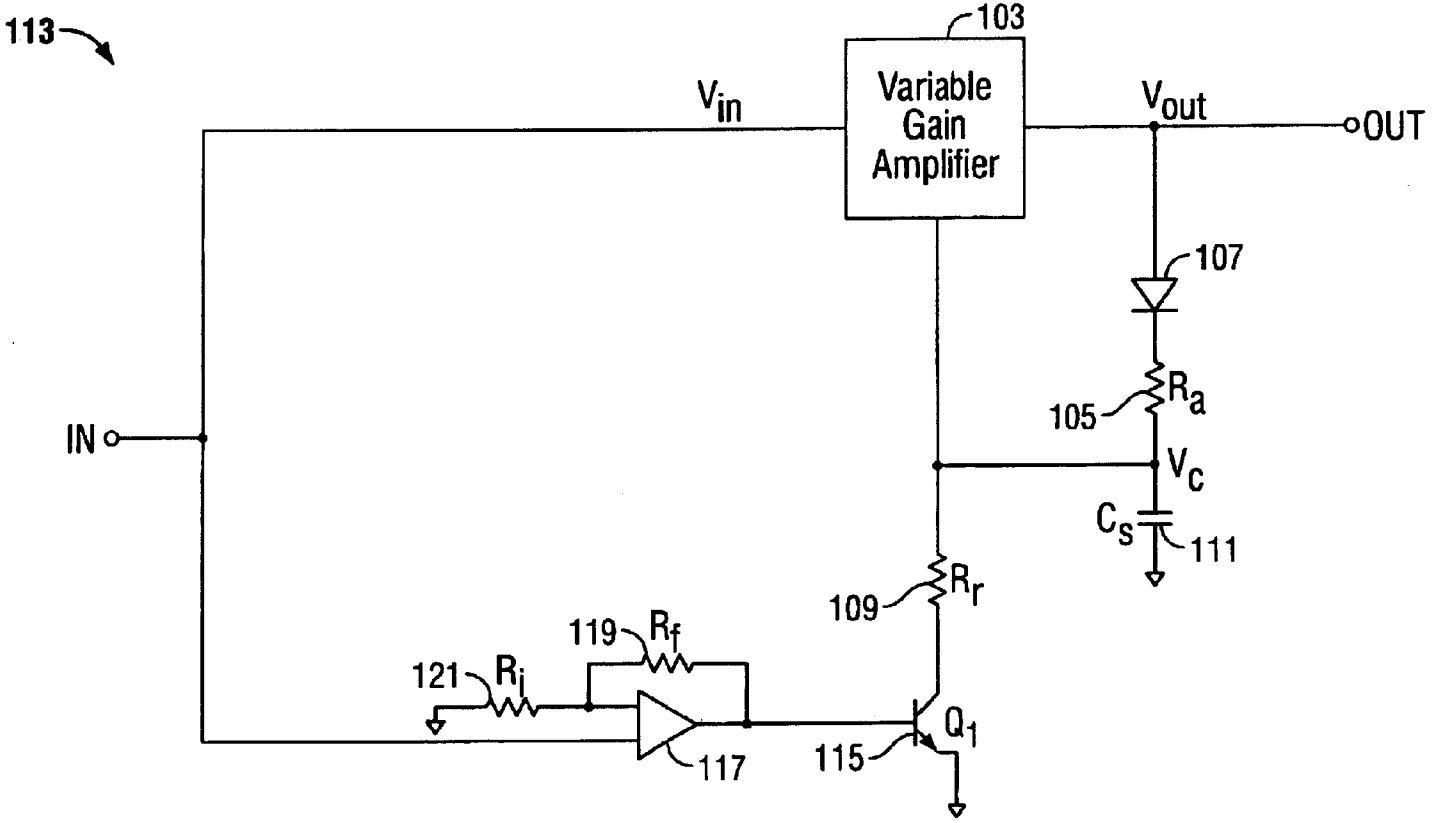
FIG. 1B (Prior Art)
FIG. 1B illustrates another prior art automatic gain control circuit.
Figure 2:
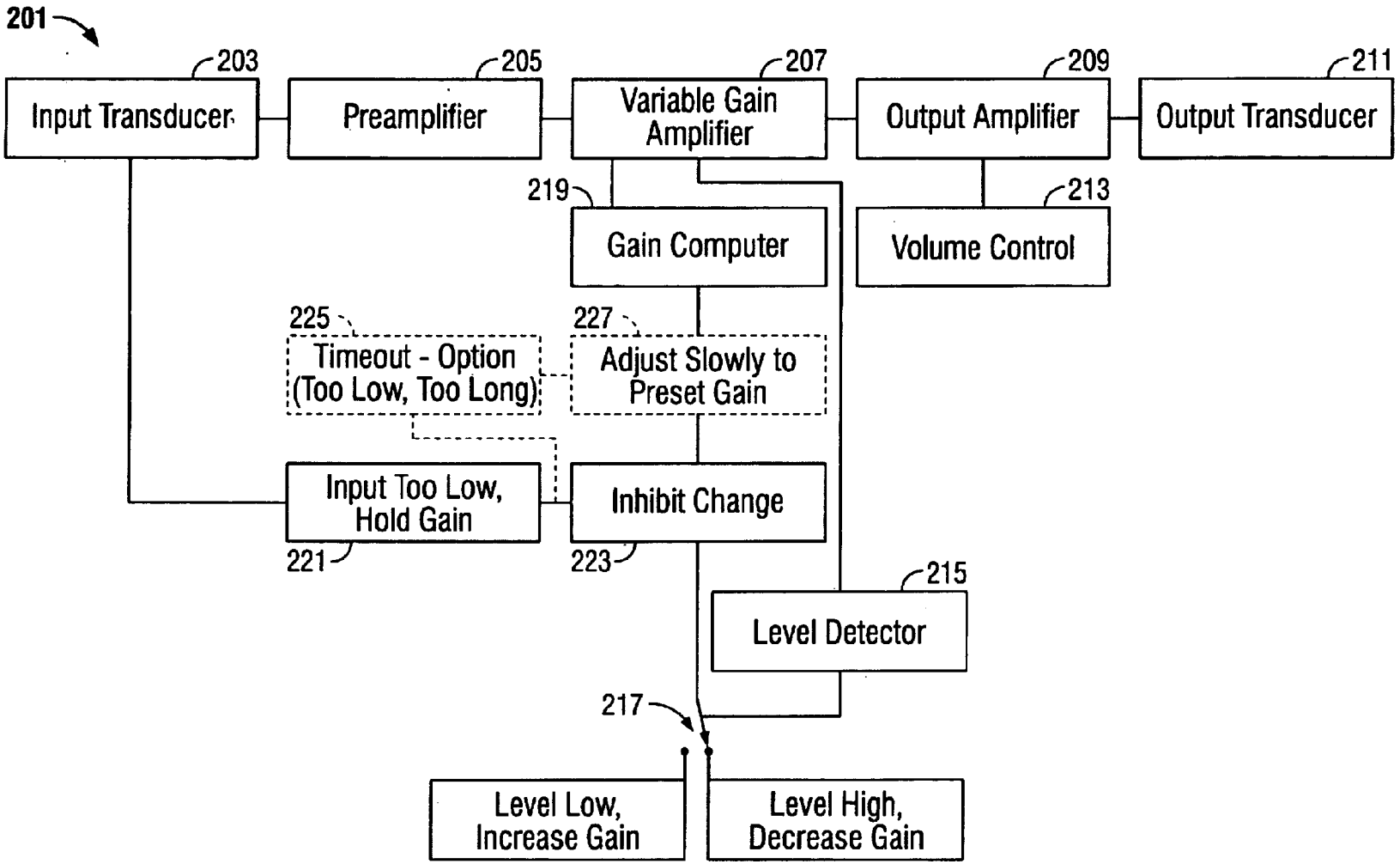
FIG. 2 is a functional block diagram of one embodiment of a hearing aid assembly incorporating automatic gain control functionality according to the present invention.

FIG. 2 is a functional block diagram of one embodiment of a hearing aid assembly incorporating automatic gain control functionality according to the present invention. Sound energy enters a hearing aid assembly 201 via an input transducer 203, which converts the sound energy into an electrical audio signal. The input transducer 203 may be, for example, a microphone. The electrical signal is next amplified by a preamplifier 205, then by a variable gain amplifier 207, and finally by an output amplifier 209, before being passed to an output transducer 211, which, in the case of a hearing aid, converts the electrical audio signal into sound energy for input to an ear canal of a hearing aid user/wearer. The output transducer 211 may be, for example, a speaker. Other types of transducers may also be used, such as, for example those used with cochlear implants or middle ear implants. A volume control 213 may be used to control the amplification of the output amplifier 209 (i.e., overall gain). While FIG. 2 shows a hearing aid embodiment having preamplification and output amplification, it should be understood that the automatic gain control functionality of the present invention may be used in other embodiments, such as, for example, ones eliminating one or both of the preamplifier 205 and output amplifier 209 or performing such functionality digitally.

A portion of the electrical audio signal is also sent to a detector 215. While FIG. 2 illustrates that the portion of the electrical audio signal is received by the detector 215 from the variable gain amplifier 207, the portion of the electrical audio signal may be received from other points in the hearing aid assembly 201. The detected electrical audio signal portion is then used to control a switch 217 to increase or decrease gain, as the case may be, to a predetermined level or condition of stability via a gain computer 219. In general, for low level audio signals, the gain is increased, and for high level audio signals, the gain is decreased. For very low input signals, typically background noise, however, the gain computer 219 is instructed by blocks 221 and 223 to hold the gain and inhibit change, rather than to increase gain. In other words, whenever the instantaneous level of the audio input falls below a predetermined threshold value, the gain is held at essentially its current level. A delay function (not shown) may also be added to inhibit the functionality of blocks 221 and 223 to improve response times to signals near the predetermined threshold value.

An optional timeout function, represented by blocks 225 and 227 in FIG. 2, may also be added to the low level condition (i.e., when the input signal falls below the predetermined threshold value). For cases where the timeout function is added, if the input remains low for a predetermined time, the gain is slowly returned to a predetermined level that may be greater or lesser than the inhibited level (i.e., greater or lesser than the level at which the gain was originally held). In other words, addition of the timeout function of blocks 225 and 227 has the effect of holding the gain at its most recent level and to slowly change it to the predetermined level during a predetermined time period (e.g., a number of seconds). The timeout function may be added to combat the tendency of inhibit circuitry to eventually recover to full gain because of, for example, capacitor leakage or lack of an infinitely open resistor.

In operation, therefore, the hearing aid assembly 201 of FIG. 2 generally discriminates between speech and noise. During speech, i.e., when the audio input is above a predetermined low level threshold, normal automatic gain control is enabled. However, during noise, i.e., when the audio input falls below the predetermined low level threshold, the automatic gain control is disabled or placed in a hold condition. Such operation prevents the problem of "pumping" discussed above with respect to many prior art hearing aids. In addition, the embodiment of FIG. 2 has a much better defined threshold and a clearer on/off condition than those achieved by prior designs.

Figure 3:
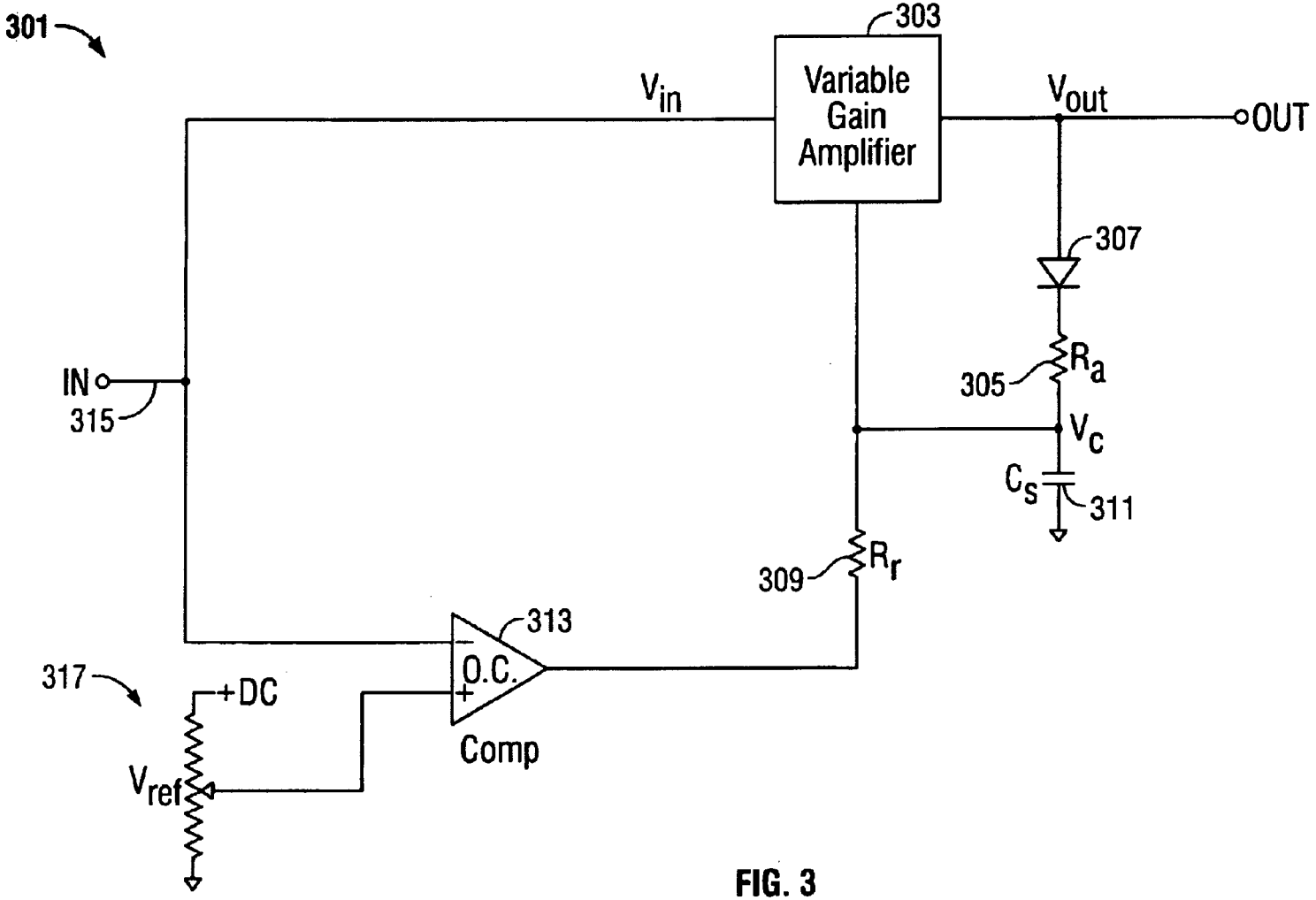
FIG. 3 is one embodiment of an automatic gain control circuit of the present invention.

FIG. 3 is one embodiment of an automatic gain control circuit of the present invention. A circuit 301 of FIG. 3 may perform the functionality discussed above with respect to FIG. 2. The circuit 301 comprises a variable gain amplifier 303, an attack time constant resistor $R_a$ 305, a diode 307, a release or recovery time constant resistor $R_r$ 309, a storage capacitor $C_S$ 311, and an open collector comparator 313. As can be seen, the open collector comparator 313 is placed in series with the release or recovery time constant resistor $R_r$ 309. The inverting input of the open collector comparator 313 is connected to an electrical audio signal input 315, and the non-inverting input of the open-collector comparator 313 is connected to a reference voltage 317. The reference voltage 317 may be, for example, that corresponding to 65 dB SPL instantaneous.

While the instantaneous value of the electrical audio signal input 315 exceeds the threshold of the open collector comparator 313 (i.e., above the reference voltage 317), the output of the open collector comparator 313 is connected to ground. This in turn connects the release or recovery time constant resistor $R_r$ 309 to ground, and the automatic gain control operates normally (i.e., like conventional designs having any given configuration). In other words, for lower audio input signals, the gain is increased to a more stable condition, and for higher audio input signals the gain is decreased to a more stable condition.

While the instantaneous value of the electrical audio signal input 315 is below the threshold of the open collector comparator 313 (i.e., below the reference voltage 317), however, the output of the open collector comparator is essentially open circuit. Since there is no discharge path for the storage capacitor 311, the gain remains at the level it was prior to the transition of the open collector comparator 313. This may be described as a hold or inhibit condition. (The term instantaneous mentioned above may be described as a very small time, such as, for example, the slew rate of the comparator or other detecting means).

Once the circuit 301 is in the hold or inhibit condition, if the speech input next received is at the previous level, the gain will already be set at the proper amount. If the speech input is louder, the circuit will reduce the gain. If the speech is lower or quieter, the circuit will increase the gain.

In the embodiment of FIG. 3, the release time constant appears to become somewhat dependent on the input signal level. Specifically, for very large inputs, the input is above the predetermined threshold for nearly, but not more than, 50% of the time. Thus, for very large signals as such, the release time constant is slightly larger than twice that expected from prior art automatic gain control circuits having the same component values. However, for low level inputs that only occasionally exceed the predetermined threshold, the input is above the predetermined threshold for approximately only 1–2% of the time. Thus, the actual release time is approximately 50–100 times longer than that expected from prior art automatic gain control circuits. For inputs that never exceed the threshold (i.e., background noise rather than speech), the release time constant approaches infinity.

Figure 4:
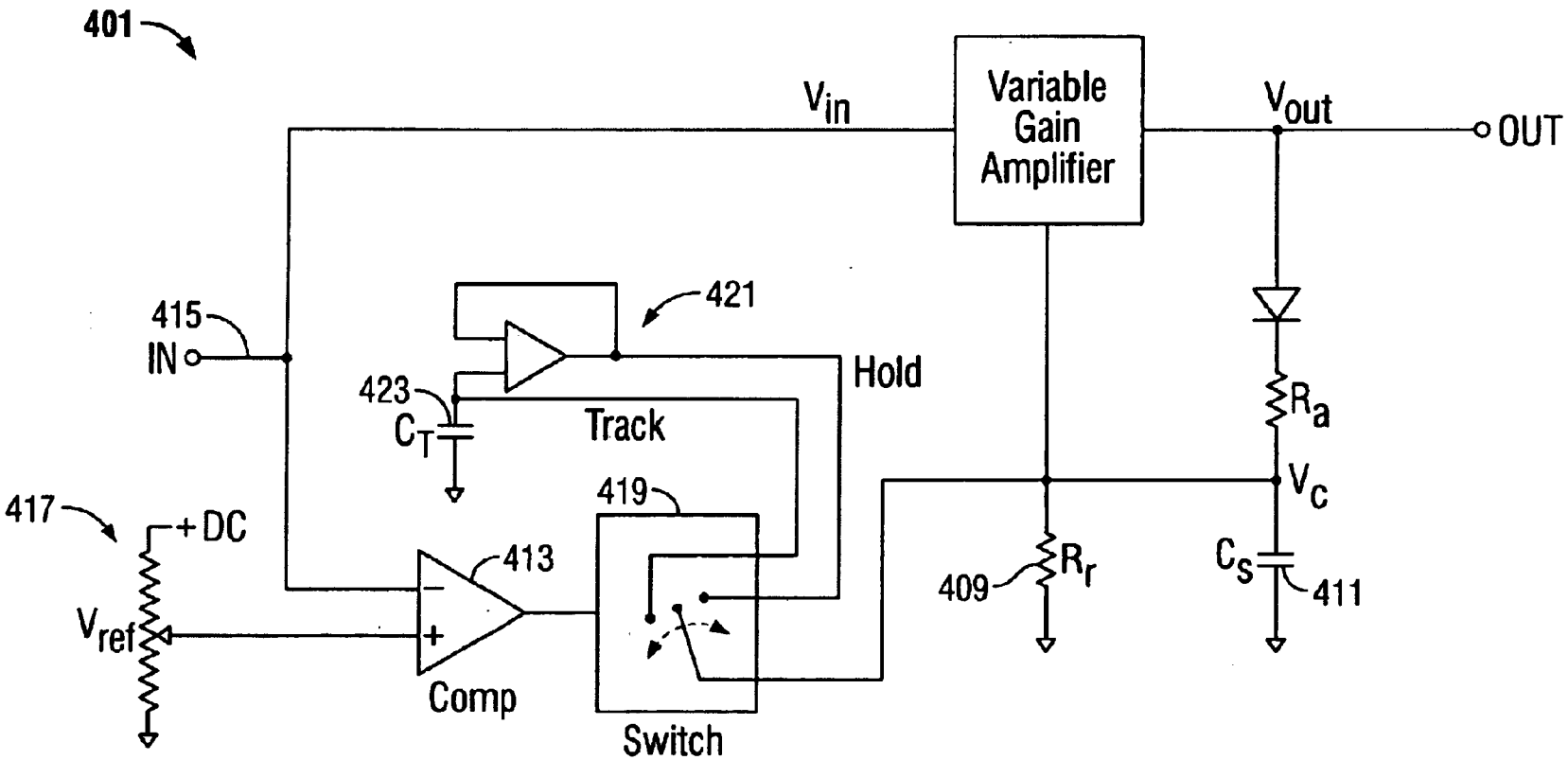
FIG. 4 is another embodiment of an automatic gain control circuit of the present invention.

FIG. 4 is another embodiment of an automatic gain control circuit of the present invention. A circuit 401 of FIG. 4 is similar to circuit 301 found in FIG. 3, except that a switch 419 is added that is driven by comparator 413. A voltage follower buffer 421 and tracking capacitor $C_T$ 423 are also added as shown.

In the embodiment of FIG. 4, when an audio signal input 415 is above the threshold of the open collector comparator 413 (i.e., above reference voltage 417), the output of the comparator drives switch 419 such that storage capacitor $C_S$ 411 is connected and the automatic gain control portion of the circuit 401 operates normally (i.e., like conventional designs having any given configuration). During this time the tracking capacitor $C_T$ 423 tracks the storage capacitor $C_S$ 411 (i.e., $V_C$), which determines the gain setting as mentioned above.

When audio signal input 415 is below the threshold (i.e., below reference voltage 417), however, the output of the comparator 413 drives switch 419 such that the tracking capacitor $C_T$ 423, buffered by buffer 421, is routed through switch 419 and forces storage capacitor $C_S$ 411 to retain its most recent voltage value. In this case, the output of the buffer 421 cannot be discharged by release or recovery time constant resistor $R_r$ 409, and thus the gain remains unchanged from its most recent value (i.e., as set by tracking capacitor $C_T$ 423).

In the embodiment of FIG. 4, therefore, the storage capacitor $C_S$ 411 is forced by the open collector comparator 413 (i.e., the charge is held directly via the tracking capacitor $C_T$ 423), rather than having it switch the release or recovery time constant resistor $R_r$, as shown in FIG. 3.

Figure 5:
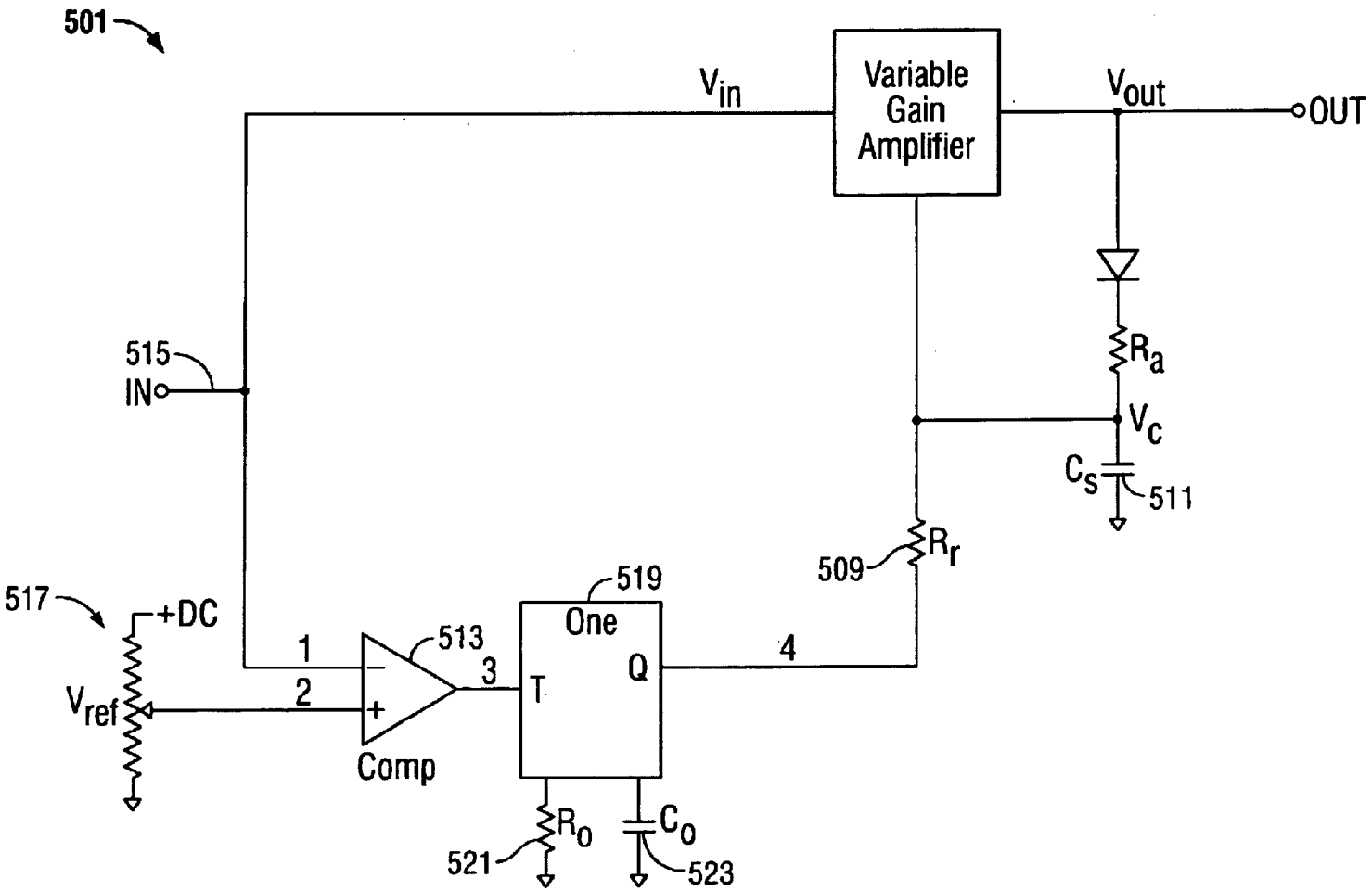
FIG. 5 is a further embodiment of an automatic gain control circuit of the present invention.

FIG. 5 is a further embodiment of an automatic gain control circuit of the present invention. A circuit 501 of FIG. 5 is similar to circuit 301 found in FIG. 3, except that a one-shot 519 is added between comparator 513 and release or recovery time constant resistor $R_r$ 509. In operation, the output to comparator 513 drives a trigger input T of one-shot 519. An open collector output Q of one-shot 519 performs switching on the release or recovery time constant resistor $R_r$ 509. When the comparator 513 triggers one-shot 519, the release or recovery time constant resistor $R_r$ 509 is connected to ground for a time dependent on the values of one-shot resistor $R_O$ 521 and one-shot capacitor $C_O$ 523 as well as the input level.

More specifically, when the instantaneous value of audio signal input 515 exceeds the threshold of the open collector comparator comparator 513 (i.e., above reference voltage 517), the output of the comparator 513 triggers one-shot 519 such that output Q of one-shot 519 becomes connected to ground. This in turn causes the release or recovery time constant resistor $R_r$ 509 to be connected to ground, but only for a limited time determined by the values of one-shot resistor $R_O$ 521 and one-shot capacitor $C_O$ 523, which limited time may be on the order of, for example, approximately 3–5 mS. In other words, the circuit operates in a "normal" mode (i.e., like conventional automatic gain circuits having any given configuration) only for some limited time for any instantaneous values of the audio signal input 515 that rise above the threshold of the comparator 513. More specifically, there are several possible one-shot trigger/response configurations. One is described as an example. Assume that the one-shot is configured to extend any above threshold response after the input goes below the threshold and that the time constant is a few milliseconds. For high level inputs where the previous release duty cycle approached 50%, the one-shot will make the duty cycle nearly 100%. For low level inputs where the duty cycle approached 2%, the one-shot will make the duty cycle nearly 50%. Thus, the recovery time constant which previously varied over a 50:1 range (making recovery to soft sounds very slow), now varies over only a 2:1 range (recovery to soft sounds is essentially the same as recovery to loud sounds). In the extreme, a very long one-shot time constant (approaching the normal release time constant) will cause the circuit to behave identically to a conventional AGC. Such a configuration greatly reduces the input signal level dependency of the release time constant, discussed above with reference to FIG. 3.

Referring again to FIG. 5 when the instantaneous value of the audio signal input 515 falls below the threshold of the open collector comparator 513 (i.e., below the reference voltage 517), the output of the open collector comparator 513 does not trigger one-shot 519. In this case, the output Q of one-shot 519 is essentially open circuit. Since there is no discharge path for storage capacitor $C_S$ 511, the gain remains at the level it was prior to the transition of the open collector comparator 513. Again, this may be described as a hold or inhibit condition.

Once the circuit 501 is in the hold or inhibit condition, if the speech input next received is at the previous level, the gain will already be set at the proper amount.

It should be understood that the one-shot 519 may also be triggered on the leading edge instead of the trailing edge of the threshold crossing.

Figure 6:
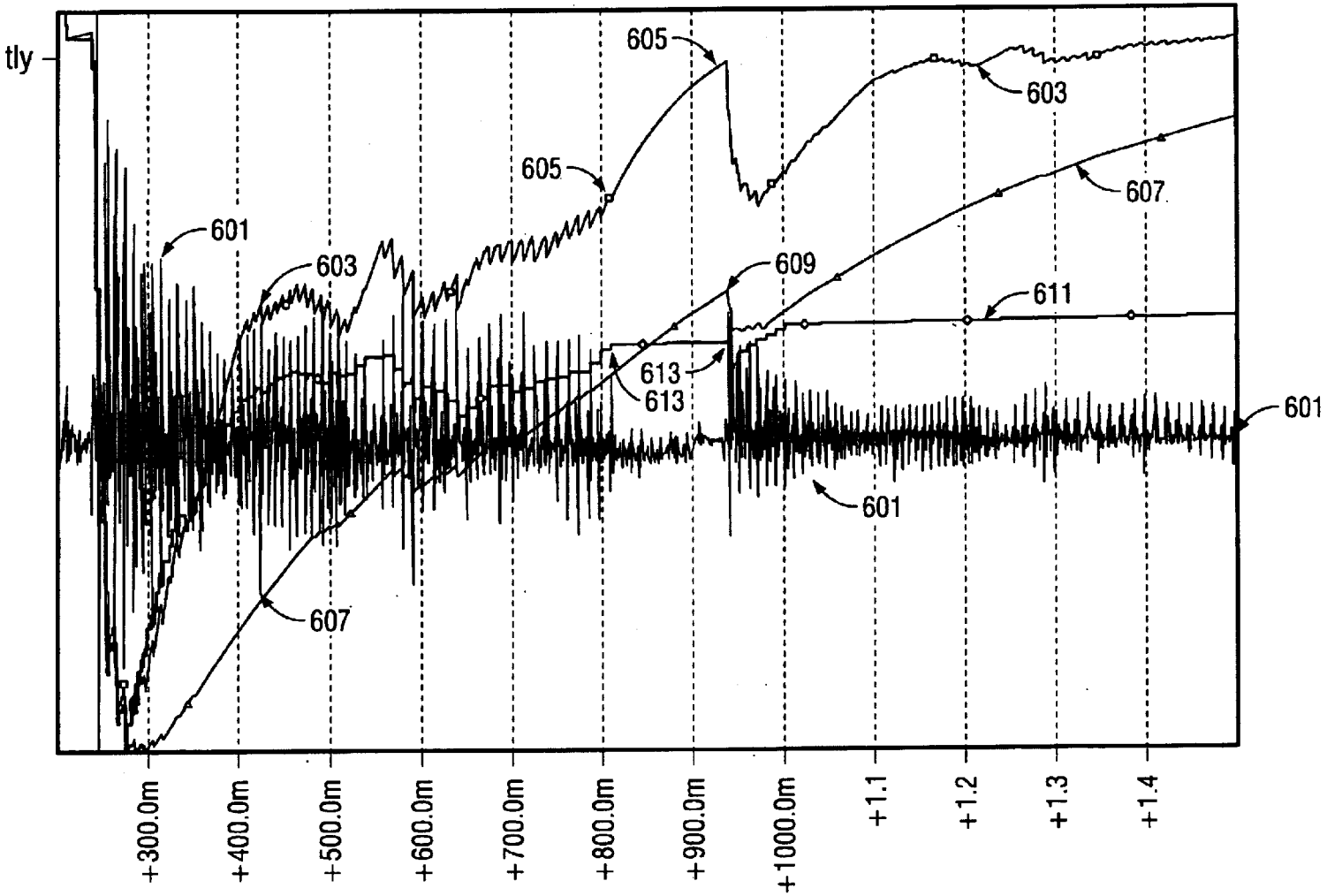
FIG. 6 illustrates detected control voltage curves for two prior art automatic gain control configurations as compared to one utilizing the circuit of FIG. 5.

FIG. 6 illustrates detected control voltage curves for two prior art automatic gain control configurations as compared to one utilizing the circuit of FIG. 5. Waveform envelope 601 represents the digitized result of a male talker enunciating the phrase "Say the word" followed by the same phrase 10 dB lower. Curve 603 represents a detected voltage curve for a prior art automatic gain control circuit responding to the waveform envelope 601. The prior art automatic gain control circuit resulting in curve 603 utilizes a relatively fast time constant (10 mS attack/100 mS release). As can be seen from curve 603, such a configuration produces very fast gain changes, typically referred to as syllabic compression. It also produces extreme "pumping," discussed above, as can be seen by the very large gain boost (see curve portion 605 on curve 603) that occurs during the pause (approximately 150 mS) between the speaking of the two phrases (i.e., when only background noise is present).

Curve 607 results from the same prior art automatic gain control circuit that produced curve 603, except that a five times longer release time was used. As can be seen, the gain changes are smoother and there is less gain increase during the pause between the speaking of the two phrases (see curve portion 609 of curve 607). However, the gain still increases noticeably during the pause, i.e., during a fairly short time (approximately 150 mS) that background noise is present. In addition, there is a problem recovering gain as shown in the very early portion of curve 607.

Curve 611 represents the detected control voltage curve resulting from automatic gain control circuit 501 of FIG. 5, using component values to match attack/release times of the circuit of FIG. 3 for loud sounds. As can be seen, curve 611 has a fast recovery from a sudden loud sound, nearly equal to the fast recovery of curve 603. It also has a good response when gain changes are needed, without the wild swings shown in curve 603 and no gain increase during the pause (i.e., background noise or "quiet" period). The gain instead holds its last value during that quiet period (see curve portion 613 of curve 611), with no reduction in gain. As can be seen, curve 611, particularly in the early stages, has a squared shape, illustrating the instantaneous nature of the adjust and hold characteristics of the present invention.

As is evident from FIG. 6, the automatic gain control functionality of the present invention greatly reduces the "pumping" that results from prior art automatic gain control circuits. Also, the present invention reduces feedback, preserves the ambient signal to noise ratio, resulting in a more linear sounding automatic gain control, and enables higher compression ratios, resulting in a greater portion of real world sound being heard. In addition, the present invention enables a reduced storage capacitor size (approximately ½ to ⅓ smaller), and provides a "volume clue" to a hearing aid wearer, that is, loud is worth listening to while soft may be ignored. Note that in this example the switch threshold has been arbitrarily raised so that the final portion of the second phrase is considered 'noise' in order to demonstrate the long hold time with no gain change.

Figure 7:
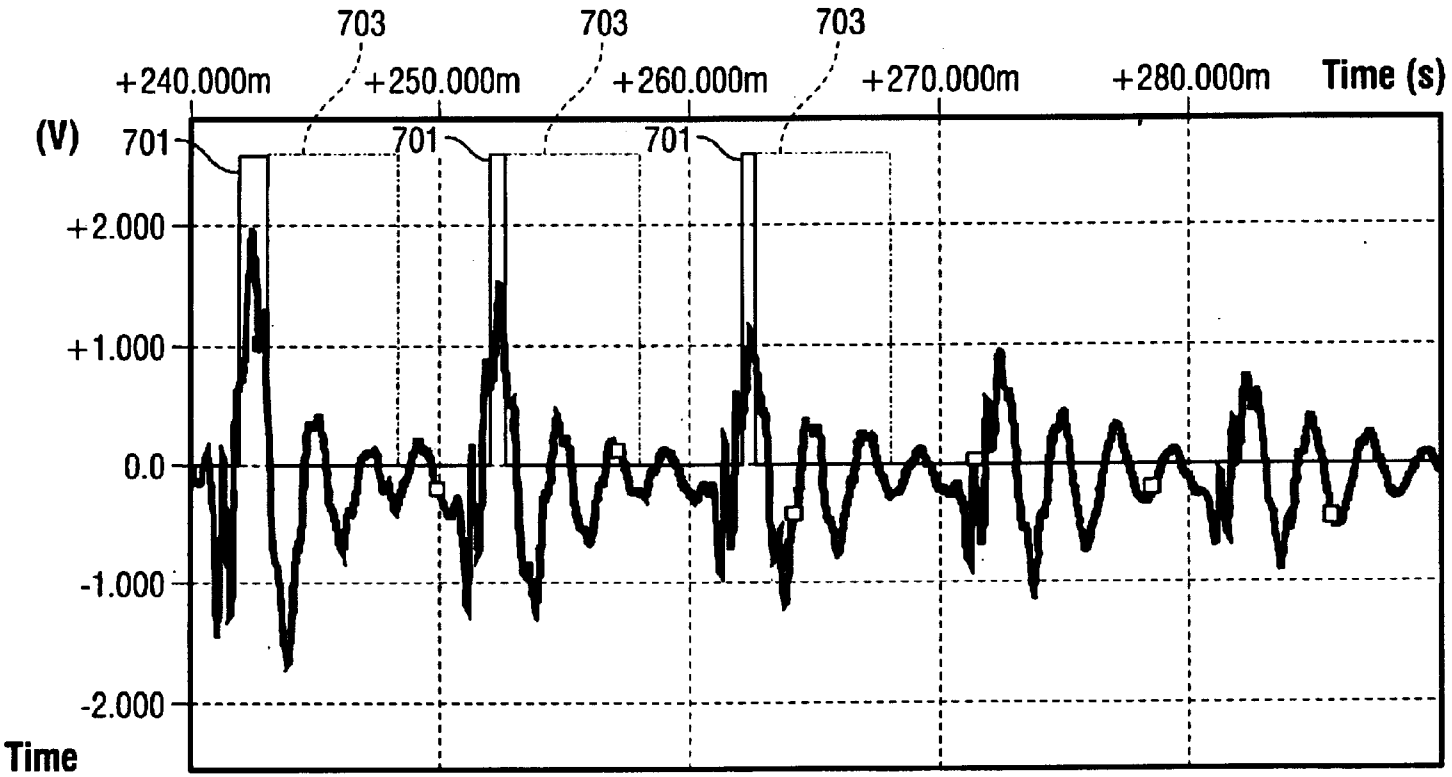
FIG. 7 illustrates the amplitude of a part of the "A" in the word "Say" from a male talker speaking the phrase set forth in FIG. 6.

FIG. 7 illustrates the amplitude of a part of the "A" in the word "Say" from a male talker speaking the phrase set forth in FIG. 6. In other words, FIG. 7 is a "zoom in" of the graph of FIG. 6. FIG. 7 is an actual 12 bit sample where the vertical scale is +/−2048. Since this is an actual recording, it is interesting to note the unsymmetrical nature of the peaks. In this illustration, the switching threshold (typically 65 dB SPL instantaneous) has been set to +1.000 in order to provide an easy to see example. The square wave using solid lines 701 represents the output of a comparator. Whenever the instantaneous level is below +1.000, the comparator output is 0. Whenever the instantaneous level is above +1.000, the comparator goes to its high state. Note that for signals similar to this example, the comparator is "on" only a small part of the time. This represents a soft speech sound and illustrates that the AGC will only be in "normal" operation a small portion of the time. If the signal were at a higher level (or the threshold at a lower level), the comparator would be "on" more of the time and the AGC would be in "normal" mode more of the time. This particular example thus illustrates an apparent problem with signals that are only slightly above the switch threshold. Because the comparator is only "on" for a small portion of the time, recovery will be proportionately slower.

The current invention solves this apparent problem utilizing a delay circuit which may be, for example, a re-triggerable one-shot. While it can be triggered on either the positive or negative crossing of the switching threshold, this example shows triggering on the negative crossing. In the graph, the extended comparator "on" time can be seen shown in the dashed lines 703. In this case the extended time is only about 5 mS but acts to increase the "on" time significantly without significant reduction in the "hold" function.

While the automatic gain control implementations of the present invention have been described in fairly fixed and analog terms, it is anticipated that other implementations using fixed, manually adjustable or programmable variables, or those in digital environments, or those having more than one channel may also be used and are considered within the scope of the present invention.

In view of the above detailed description of the present invention and associated drawings, other modifications and variations will now become apparent to those skilled in the art. It should be apparent that such other modifications and variations may be effected without departing from the spirit and scope of the present invention.

What is claimed and desired to be secured by Letters Patent is:

1. A hearing aid comprising:

an input transducer for receiving sound energy and for converting it into an electrical signal;

circuitry for receiving the electrical signal and for controlling the gain of the electrical signal, the circuitry having a single attack time constant and only a first release time constant and a second release time constant, the first release time constant being shorter than the second release time constant;

a switch for switching between only the first release time constant and the second release time constant based on the amplitude of the electrical signal; and an output transducer for converting the electrical signal into sound energy.

2. The hearing aid of claim 1 wherein the first release time constant is less than a second and the second release time constant is more than a minute.

3. The hearing aid of claim 1 wherein the first release time constant is less than three seconds and the second release time constant is more than a minute.

4. The hearing aid of claim 1 wherein the switch selects the first release time constant if an instantaneous value of the electrical signal is greater than a predetermined threshold, and the second release time constant if an instantaneous value of the electrical signal is less than the predetermined threshold.

5. The hearing aid of claim 4 wherein the circuitry adjusts the gain of the electrical signal to a predetermined level if a predetermined plurality of consecutive instantaneous values of the electrical signal are below the predetermined threshold.

6. The hearing aid of claim 4 wherein the predetermined threshold is variable.

7. The hearing aid of claim 4 wherein the predetermined threshold is programmable and stored in memory.

8. The hearing aid of claim 4 wherein the predetermined threshold is set manually.

9. The hearing aid of claim 4 wherein selection of the second release time constant is delayed a predetermined time period when the instantaneous value of the electrical signal falls below the predetermined threshold.

10. The hearing aid of claim 4 wherein the first release time constant is selected for a predetermined time period after the instantaneous value of the electrical signal rises above the predetermined threshold even if the instantaneous value of the electrical signal falls below the predetermined threshold during the predetermined time period.

11. The hearing aid of claim 1 wherein the first release time constant is variable.

12. The hearing aid of claim 1 wherein the switch comprises at least a comparator.

13. The hearing aid of claim 1 wherein the switch comprises at least a comparator and a one-shot.

14. A hearing aid comprising:

an input transducer for receiving sound energy and for converting the sound energy into an electrical signal;

circuitry for receiving the electrical signal and for controlling the gain of the electrical signal, the circuitry having a single attack time constant, and switching between only a first release time constant and a second longer release time constant based on the amplitude of the electrical signal; and an output transducer for converting the electrical signal into sound energy.

15. The hearing aid of claim 14 wherein the first release time constant is less than three seconds and the second release time constant is more than a minute.

16. The hearing aid of claim 14 wherein the circuitry selects the first release time constant if an instantaneous value of the electrical signal is greater than a predetermined threshold, and the second release time constant if an instantaneous value of the electrical signal is less than the predetermined threshold.

17. The hearing aid of claim 16 wherein the predetermined threshold comprises approximately 65 dB SPL.

18. The hearing aid of claim 16 wherein selection of the second release time constant is delayed a predetermined time period when the instantaneous value of the electrical signal falls below the predetermined threshold.

19. The hearing aid of claim 16 wherein the first release time constant is selected for a predetermined time period after the instantaneous value of the electrical signal rises above the predetermined threshold even if the instantaneous value of the electrical signal falls below the predetermined threshold during the predetermined time period.

20. The hearing aid of claim 16 wherein the circuitry adjusts the gain of the electrical signal to a predetermined level if a predetermined plurality of consecutive instantaneous values of the electrical signal are below the predetermined threshold.

* * * * *